US011564033B2

(12) United States Patent
Silver

(10) Patent No.: US 11,564,033 B2
(45) Date of Patent: Jan. 24, 2023

(54) VIBRATION AND FORCE CANCELLING TRANSDUCER ASSEMBLY HAVING A PASSIVE RADIATOR

(71) Applicant: Apple Inc., Cupertino, CA (US)

(72) Inventor: Jason D. Silver, Mountain View, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/343,515

(22) Filed: Jun. 9, 2021

(65) Prior Publication Data

US 2022/0400338 A1 Dec. 15, 2022

(51) Int. Cl.

| | |
|---|---|
| ***H04R 1/00*** | (2006.01) |
| ***H04R 9/06*** | (2006.01) |
| ***H04R 3/00*** | (2006.01) |
| ***H04R 1/02*** | (2006.01) |

(52) U.S. Cl.

CPC ..... *H04R 3/002* (2013.01); *H04R 1/02* (2013.01); *H04R 9/06* (2013.01)

(58) Field of Classification Search

CPC . H04R 1/00; H04R 1/02; H04R 1/021; H04R 1/023; H04R 1/025; H04R 1/026; H04R 1/028; H04R 9/02; H04R 9/04; H04R 9/06; H04R 9/025; H04R 19/02; H04R 2400/00; H04R 2400/07; H04R 2400/11; H04R 3/002

See application file for complete search history.

(56) References Cited

U.S. PATENT DOCUMENTS

| | | | |
|---|---|---|---|
| 4,472,605 | A | 9/1984 | Klein |
| 4,783,820 | A | 11/1988 | Lyngdorf et al. |
| 5,664,020 | A | 9/1997 | Goldfarb et al. |
| 6,628,790 | B1 | 9/2003 | Klein |
| 6,985,593 | B2 | 1/2006 | Nichols et al. |

(Continued)

FOREIGN PATENT DOCUMENTS

| | | |
|---|---|---|
| DE | 2608068 | 9/1977 |
| DE | 2608068 A1 | 9/1977 |

OTHER PUBLICATIONS

Notice of Allowance for U.S. Appl. No. 17/343,510 dated Jun. 24, 2022, 8 pages.

(Continued)

*Primary Examiner* — Thang V Tran

(74) *Attorney, Agent, or Firm* — Womble Bond Dickinson (US) LLP

(57) ABSTRACT

A transducer assembly including an enclosure having a bottom enclosure wall and a side enclosure wall that together define an enclosure volume; a first mass movably coupled to the enclosure and defining a first radiating area; a second mass movably coupled to the enclosure and defining a second radiating area; and a third mass movably coupled to the enclosure and defining a third radiating area, the third mass comprising a passive radiator and a third suspension member coupling the passive radiator to the enclosure, and wherein the first radiating area and the second radiating area have a combined radiating area that is different than the third radiating area and the combined radiating area is balanced relative to the third radiating area to reduce enclosure vibrations caused by a movement of the first mass and the second mass relative to the enclosure.

18 Claims, 10 Drawing Sheets

(56) References Cited

U.S. PATENT DOCUMENTS

| | | | | |
|---|---|---|---|---|
| 7,062,054 | B2 | 6/2006 | Nishikawa et al. | |
| 7,539,318 | B2 | 5/2009 | Onuma et al. | |
| 7,912,240 | B2 | 3/2011 | Madaffari et al. | |
| 7,974,431 | B2 | 7/2011 | Saiki | |
| 8,290,198 | B2 | 10/2012 | Ogasawara et al. | |
| 9,191,747 | B2 | 11/2015 | Dodd | |
| 9,203,137 | B1 | 12/2015 | Guterman et al. | |
| 9,241,206 | B2 * | 1/2016 | Nevill | H04R 1/02 |
| 9,294,841 | B2 * | 3/2016 | Sahyoun | H04R 1/2834 |
| 9,571,934 | B2 * | 2/2017 | Stabile | H04R 1/2834 |
| 9,980,036 | B2 * | 5/2018 | Proni | H04R 1/2834 |
| 10,110,991 | B2 | 10/2018 | Crosby et al. | |
| 10,631,071 | B2 | 4/2020 | Wu et al. | |
| 10,631,096 | B1 | 4/2020 | Garcia Selva et al. | |
| 2003/0048920 | A1 | 3/2003 | Van Halteren et al. | |
| 2004/0028254 | A1 | 2/2004 | Bachmann et al. | |
| 2004/0195039 | A1 * | 10/2004 | Sahyoun | H04R 7/122 181/157 |
| 2005/0220320 | A1 | 10/2005 | Kim et al. | |
| 2006/0002569 | A1 | 1/2006 | Dickie | |
| 2006/0093180 | A1 | 5/2006 | Kim | |
| 2006/0280321 | A1 | 12/2006 | Miura et al. | |
| 2007/0014418 | A1 | 1/2007 | Eatwell et al. | |
| 2007/0098209 | A1 | 5/2007 | Setiabudi et al. | |
| 2008/0044044 | A1 | 2/2008 | Madaffari et al. | |
| 2008/0205686 | A1 | 8/2008 | Tagami et al. | |
| 2009/0136065 | A1 | 5/2009 | Vano | |
| 2010/0027816 | A1 | 2/2010 | Bastyr et al. | |
| 2011/0274308 | A1 * | 11/2011 | Doh | H04R 9/06 381/398 |
| 2012/0057730 | A1 | 3/2012 | Fujise et al. | |
| 2013/0195311 | A1 | 8/2013 | Sahyoun | |
| 2014/0211963 | A1 | 7/2014 | Dodd | |
| 2015/0110335 | A1 | 4/2015 | Telemaque et al. | |
| 2015/0281844 | A1 | 10/2015 | Stabile | |
| 2015/0304748 | A1 | 10/2015 | Yamada | |
| 2016/0021441 | A1 | 1/2016 | Shao et al. | |
| 2016/0119718 | A1 | 4/2016 | Yang et al. | |
| 2016/0205479 | A1 | 7/2016 | Tomar | |
| 2017/0055069 | A1 | 2/2017 | Lee et al. | |
| 2017/0272866 | A1 | 9/2017 | Griffiths | |
| 2018/0014115 | A1 | 1/2018 | Crosby et al. | |
| 2018/0367919 | A1 | 12/2018 | Xiao et al. | |

OTHER PUBLICATIONS

Notice of Allowance for U.S. Appl. No. 17/343,510 dated Sep. 30, 2022, 5 pages.

* cited by examiner

VIBRATION AND FORCE CANCELLING TRANSDUCER ASSEMBLY HAVING A PASSIVE RADIATOR

FIELD

An aspect of the disclosure is directed to a vibration and force cancelling transducer assembly including a transducer assembly having tuned stiffnesses and masses for vibration and force cancelling. Other aspects are also described and claimed.

BACKGROUND

In modern consumer electronics, audio capability is playing an increasingly larger role as improvements in digital audio signal processing and audio content delivery continue to happen. In this aspect, there is a wide range of consumer electronics devices that can benefit from improved audio performance. For instance, smart phones include, for example, electro-acoustic transducers such as speakers that can benefit from improved audio performance. Smart phones, however, do not have sufficient space to house much larger high fidelity sound output devices. This is also true for some portable personal computers such as laptop, notebook, and tablet computers, and, to a lesser extent, desktop personal computers with built-in speakers. The speakers incorporated within these devices may use a moving coil motor to drive sound output. The moving coil motor may include a diaphragm, voice coil and magnet assembly positioned within a frame. In some cases, however, the force output by the moving coil motor may be transmitted to the device enclosure, causing an undesirable rattling, shaking or hopping of the system.

SUMMARY

An aspect of the disclosure is directed to a transducer assembly (e.g., a loudspeaker), which provides a force-balancing construction to eliminate, or reduce, forces that may be transmitted to the system in which the transducer is installed or integrated, while maximizing the acoustic output. For example, an operating loudspeaker can cause dynamic imbalances that cause the product to excessively vibrate or slide along a surface. This movement may be up and down, to the side, a rotation, or a combination of these movements. The product can literally "hop" and momentarily lose contact with the surface it is on, or it can only lose its grip (but not leave the surface), but instead slide or "walk" over time along a table for example. Sometimes the product's bottom will maintain its position on the table, if for example mounted on soft springs like foam pads/feet, while the enclosure may still be vibrating with large amplitudes. This can also be undesirable because vibrations can interfere with the function of cameras in the product, making it hard to view product displays (appear blurry), or affect the user experience of touching button/controls on the product. Even if the product is turned off, pressing controls on a "squishy" product can hurt the user experience. Alternatively, if a product is mounted to a wall with screws for example, the dynamic imbalance can stress the attachment joints, potentially causing fatigue and failure, or cause the wall to vibrate.

The dynamic imbalances can be either force imbalances, moment imbalances, or both. An example of a force imbalance on the case without a moment imbalance may be a single axisymmetric transducer mounted in the center of a symmetric sealed box enclosure. Because of symmetry, there is no moment applied to the enclosure. An example of a moment imbalance on the case without a force imbalance may be two identical transducers mounted on opposite sides of a sealed box, moving acoustically in phase (mechanically out of phase), but not positioned in-line with each other. This causes a moment/couple, which can lead to rotations/rocking of product.

The instant disclosure is directed to a transducer assembly having a stiffness (or other parameter) that is tuned for reducing or eliminating imbalanced dynamic forces within the system which can cause the product to excessively vibrate or "hop" along a surface. The "stiffness" may be understood herein as referring to the extent to which the object resists deformation in response to an applied force and/or the measure of the resistance offered by the body to deformation. Representatively, in one aspect, the disclosure is directed to a transducer assembly having a spring or other compliant member with a constant k2 between the transducer and the case/enclosure. For a sealed box configuration (e.g., no ports, passive radiators, etc), this configuration can perfectly cancel forces on the case at a number of frequencies where the k2 and the damping in the spring have particular parameters that depend on other parameters in the speaker (e.g., diaphragm radiating mass (m1), hardware radiating mass (m2), back volume (kbox), m1 radiating area (s1), m2 radiating area (s2), s1 stiffness (k1), damping in other spring and leak). One representative equation for perfect force cancelling may be as follows:

$$k_2 = k_{box}\frac{S_1^2 m_2 - S_2^2 m_1 - S_1 S_2 m_1 + S_1 S_2 m_2}{m_1}$$

It should be noted that if k2 is a complex value (e.g. includes damping/loss), the right side of the equation may also be complex, so that kbox has the same fraction of damping as the k2 term. In some aspects, the same performance may be achieved where s2=0, which may allow for a top area of the assembly to be smaller.

In addition, it may be recognized that since a matched k2 may depend on stiffness of the kbox, and the stiffness of the kbox may depend on the atmospheric pressure, which may in turn depend on elevation, errors in force canceling may occur from operating the product at a different altitude then the force canceling was optimized for. In addition, if the properties of the mechanical springs with constant k2 change with temperature, that may also affect the force canceling performance. Thus, in some aspects, the disclosure further provides for a spring or other compliant member stiffness (k2) that uses an air spring (k2a) and a mechanical spring (k2m) instead of just a mechanical spring (k2=k2m+k2a). In still further aspects the vibration and force cancelling transducer assembly may include ports or passive radiators.

Representatively, in one aspect, the disclosure provides an acoustic device including an enclosure having an enclosure wall that defines an enclosure volume; a first mass movably coupled to the enclosure, the first mass comprising a sound radiating surface, a voice coil and a first suspension member; a second mass movably coupled to the enclosure, the second mass comprising a magnet assembly and a second suspension member, and wherein the first suspension member couples the first mass to the second mass, the second suspension member couples the magnet assembly to the enclosure wall, and the second suspension member is tuned to reduce enclosure vibrations caused by a movement of the first mass and the second mass relative to the enclosure. In some aspects, the second suspension member is tuned by balancing a stiffness of the second suspension member relative to a stiffness of the enclosure volume. In some aspects, only the first mass defines a radiating surface area of the transducer assembly. The first suspension member is out of plane relative to the second suspension member. In some aspects, a back volume is formed between the first mass and the second mass, and further comprises a vent port formed through the second mass to vent the back volume to the enclosure volume. The second suspension member may include a mechanical spring component and an air spring component. The mechanical spring component may include a first stiffness and the air spring component comprises a second stiffness that is different from the first stiffness. In some aspects, a ratio of the first stiffness to the second stiffness is less than about 1. In some aspects, the spring component may have a spring volume defined by a spring enclosure fixedly coupled to the enclosure, and the mechanical spring component couples the second mass to the air spring component. In some aspects, the spring volume has a first stiffness, the enclosure volume is isolated from the spring volume and includes a second air stiffness, and both the first air stiffness and the second air stiffness change proportionally in response to atmospheric pressure changes. In some aspects, a vent port is formed through the mechanical spring component to vent the spring volume to an ambient environment. The mechanical spring component may include a piston and a surround coupling the second mass to the spring volume. In some aspects, the air spring component may include a spring volume defined by a bottom portion of the magnet assembly, the enclosure wall and a surround coupling the magnet assembly to the enclosure wall, and wherein the spring volume is isolated from the enclosure volume. In some aspects, the device further includes a vent port formed through the enclosure wall to vent the enclosure volume to an ambient environment. In some aspects, a third suspension member coupling the magnet assembly to the enclosure wall.

In another aspect, the disclosure is directed to a transducer assembly including an enclosure having an enclosure wall that defines an enclosure volume; a transducer positioned within the enclosure volume, the transducer having a sound radiating surface and a voice coil coupled to a magnet assembly by a first suspension member, the first suspension member allows the sound radiating surface and the voice coil to move relative to the magnet assembly along an axis of vibration, and the magnet assembly is coupled to the enclosure by a second suspension member, the second suspension member includes an air spring component that allows the magnet assembly to move relative to the enclosure. In some aspects, the air spring component defines a compliant air volume that is isolated from the enclosure volume, and wherein a stiffness of the compliant air volume and the enclosure volume change proportionally in response to atmospheric pressure changes. In some aspects, the second suspension member includes a piston coupling the magnet assembly to a surround defining a compliant air volume of the air spring component that allows the magnet assembly to move relative to the enclosure. In some aspects, the surround is attached to a spring enclosure fixedly coupled to the enclosure wall, and the surround in combination with the spring enclosure define the compliant air volume. The second suspension member includes a first surround and a second surround that are out of plane relative to one another and couple the magnet assembly to the enclosure, the enclosure volume is between the first and second surround, and a compliant air spring volume of the air spring component is between the second surround and a bottom enclosure wall such that the compliant air spring volume is positioned below the magnet assembly.

In another aspect, the disclosure is directed to a transducer assembly including an enclosure having a bottom enclosure wall and a side enclosure wall that together define an enclosure volume; a first mass movably coupled to the enclosure and defining a first radiating area, the first mass comprising a sound radiating surface, a voice coil and a first suspension member coupling the sound radiating surface to the enclosure such that the sound radiating surface is operable to vibrate relative to the enclosure along an axis of vibration; a second mass movably coupled to the enclosure and defining a second radiating area, the second mass comprising a magnet assembly and a second suspension member coupling the magnet assembly to the enclosure; and a third mass movably coupled to the enclosure and defining a third radiating area, the third mass comprising a passive radiator and a third suspension member coupling the passive radiator to the enclosure, and wherein the first radiating area and the second radiating area have a combined radiating area that is different than the third radiating area and the combined radiating area is balanced relative to the third radiating area to reduce enclosure vibrations caused by a movement of the first mass and the second mass relative to the enclosure. In some aspects, the first suspension member is axially aligned with the second suspension member. In some aspects, an effective radiating area of the second mass is zero. In some aspects, the second suspension member coupling the magnet assembly to the enclosure includes a first surround and a second surround that are out of plane relative to one another. The passive radiator may be a first passive radiator that forms part of the bottom enclosure wall and the assembly may further include a second passive radiator that forms part of the side enclosure wall. The third mass may form part of the bottom enclosure wall and separates the enclosure volume from an ambient environment outside of the enclosure. In some aspects, the enclosure further includes an interior enclosure wall that separates the enclosure volume from a passive volume between the bottom enclosure wall and the passive radiator of the third mass. In some aspects, the passive radiator forms part of the bottom enclosure wall, and the interior enclosure wall further comprises a port between the enclosure volume and the passive volume. In other aspects, the passive radiator may form part of the interior enclosure wall, and the bottom enclosure wall further comprises a port between the passive volume and an ambient environment outside of the enclosure. In some aspects, the passive radiator is a first passive radiator forming part of the bottom enclosure wall, and the assembly further includes a fourth mass defining a fourth radiating area, the fourth mass comprising a second passive radiator and a fourth suspension member coupling the second passive radiator to the interior enclosure wall.

In another aspect, the disclosure is directed to an acoustic device including an enclosure having a bottom enclosure wall and a side enclosure wall that together define an enclosure volume; a transducer positioned within the enclosure volume, the transducer having a sound radiating surface and a voice coil coupled to a magnet assembly by a first suspension member, the first suspension member allows the sound radiating surface and the voice coil to move relative to the magnet assembly along an axis of vibration, and the magnet assembly is coupled to the enclosure by a second suspension member; a first passive radiator coupled to the enclosure by a third suspension member; and a second passive radiator coupled to the enclosure by a fourth suspension member. In some aspects, the first passive radiator is coupled to the side enclosure wall and provides lateral force cancelling. In some aspects, the first passive radiator is coupled to the bottom enclosure wall and provides axial force cancelling. In some aspects, the first passive radiator is coupled to the side enclosure wall and the second passive radiator is coupled to the bottom enclosure wall. The enclosure may further include an interior enclosure wall that runs parallel to the bottom enclosure wall, and wherein the first passive radiator is coupled to the bottom enclosure wall and the second passive radiator is coupled to the interior enclosure wall. In some aspects, the enclosure further includes an interior enclosure wall that defines a passive volume between the first passive radiator and the bottom enclosure wall, and the interior enclosure wall may include an opening from the passive volume to the enclosure volume. In some aspects, the first passive radiator is coupled to an interior enclosure wall that defines a passive volume between the first passive radiator and the bottom enclosure wall, and wherein the bottom enclosure wall comprises an opening from the passive volume to an ambient environment surrounding the enclosure. The opening may include a channel that is axially aligned with the axis of vibration. The first passive radiator may define a first radiating area and the second passive radiator defines a second radiating area, and the first radiating area is different than the second radiating area. In some aspects, the device may further include a vent port formed through the magnet assembly that couples a back volume of the transducer to the enclosure volume, or through the enclosure and couples the enclosure volume to an ambient environment surrounding the enclosure.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect in this disclosure are not necessarily to the same aspect, and they mean at least one.

DETAILED DESCRIPTION

In this section we shall explain several preferred aspects of this disclosure with reference to the appended drawings. Whenever the shapes, relative positions and other aspects of the parts described in the aspects are not clearly defined, the scope of the disclosure is not limited only to the parts shown, which are meant merely for the purpose of illustration. Also, while numerous details are set forth, it is understood that some aspects of the disclosure may be practiced without these details. In other instances, well-known structures and techniques have not been shown in detail so as not to obscure the understanding of this description.

The terminology used herein is for the purpose of describing particular aspects only and is not intended to be limiting of the disclosure. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
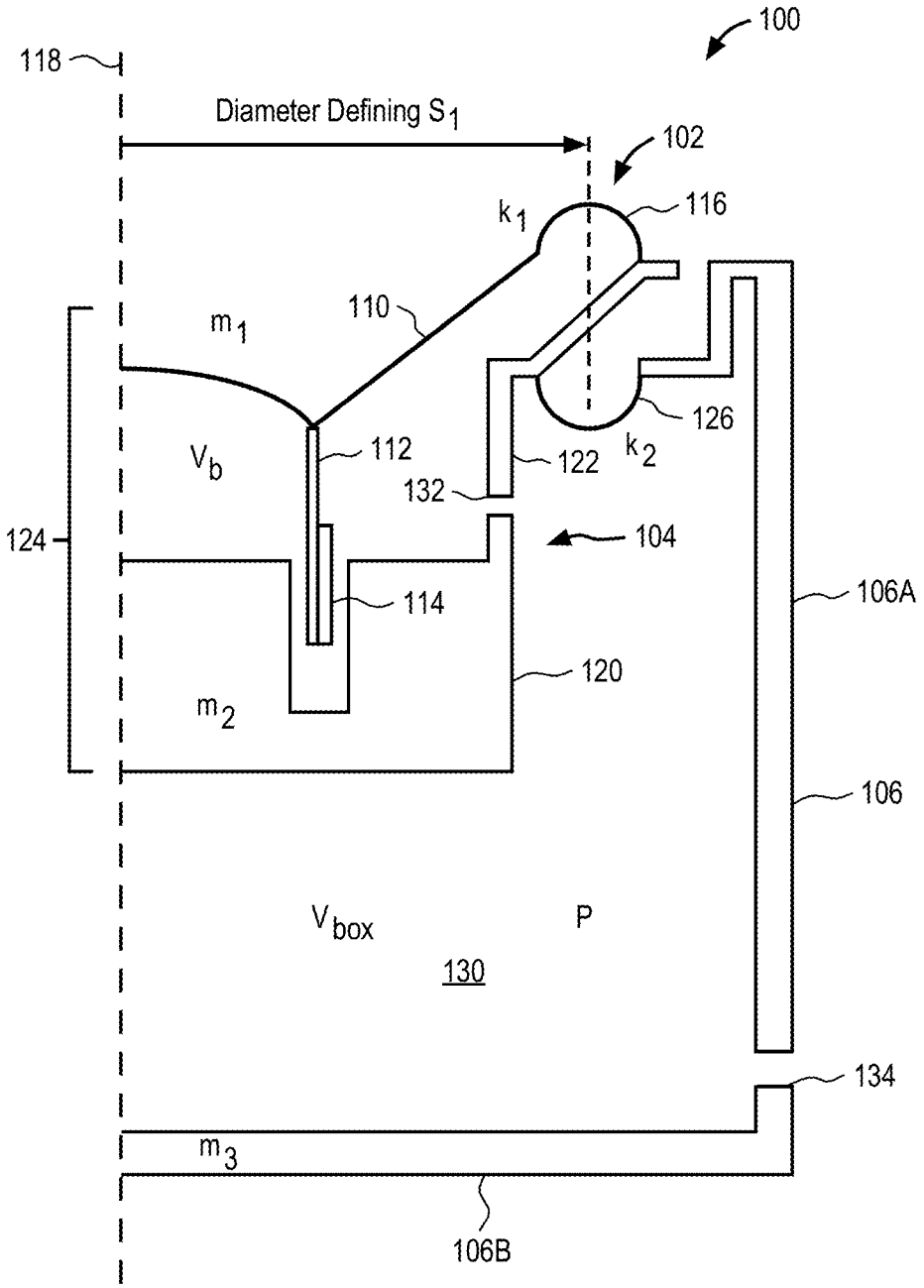
FIG. 1 illustrates a cross-sectional side view of one aspect of a transducer assembly.

FIG. 1 illustrates a cross-sectional side view of an aspect of a transducer assembly. Transducer assembly 100 may, for example, include an electro-acoustic transducer that converts electrical signals into audible signals that can be output from a device within which transducer assembly 100 is integrated. For example, transducer assembly 100 may include a speaker integrated within any type of audio output acoustic device. Transducer assembly 100 may be enclosed within a housing or enclosure of the device within which it is integrated.

Transducer assembly 100 may generally include a first mass 102, a second mass 104 and a third mass 106 which are movably coupled to one another such that they move relative to one another. The first mass 102 and the second mass 104 may, in some aspects, be considered components of an electro-acoustic transducer 124. The third mass 106 may be the enclosure, housing, case or module that the transducer 100 is coupled to. In some aspects, third mass 106 is the enclosure, housing, case or module of the device within which the transducer assembly 100 is integrated. In this aspect, the enclosure, housing, case or module may separate the components coupled thereto from a surrounding ambient environment.

Referring now in more detail to first mass 102, first mass 102 may include a sound radiating surface 110, a bobbin 112, a voice coil 114 coupled to bobbin 112, and a suspension member 116. Although bobbin 112 is included in this configuration, it should be understood that bobbin 112 is optional and could be omitted, in which case voice coil 114 may be directly attached to sound radiating surface 110. Sound radiating surface 110 may be, for example, a speaker diaphragm or another type of flexible membrane (which may include a number of material layers) capable of vibrating in response to an acoustic signal to produce acoustic or sound waves. The sound radiating surface 110 may include a top surface, face or side that is considered a sound radiating surface, face or side (or top surface, face or side in this view) in that it generates a sound that is output by the transducer assembly 100. In some aspects, the top surface, face or side may be acoustically coupled to a front volume chamber and/or an acoustic output port of the transducer assembly 100 or the device within which the transducer assembly 100 is integrated. A bottom surface, face or side may be acoustically isolated from the top surface, face or side, and considered an interior facing surface, face or side (or bottom side in this view) of sound radiating surface 110, which is acoustically coupled to a back volume (Vb) chamber of transducer assembly 100. In some aspects, the back volume (Vb) may be formed between the first mass 102 and the second mass 104 and separated from other air volumes within the assembly. In some aspects, back volume (Vb) may also be referred to as an interior volume. The bobbin 112 and the voice coil 114 may be attached to the bottom surface, face or side of sound radiating surface 110, and they may be suspended from the second mass 104 by suspension member 116. The suspension member 116 may be a flexible or compliant member (e.g., a membrane) which, in one aspect, is attached near an edge of the sound radiating surface 110 and allows for vibration of sound radiating surface 110 in directions parallel to an axis of translation or vibration 118. The axis of vibration 118 may, for example, be parallel to the z-axis of assembly 100. In still further aspects, the axis of vibration 118 may be considered parallel to, or running in the same direction as, the winding height of voice coil 114. The axis of vibration 118 may also be referred to herein as the axis of symmetry for the transducer assembly 100. In other words, while only one side of the transducer assembly 100 is shown, it may be understood as having a second side that is symmetrical, and otherwise identical, to that which is shown.

Referring now in more detail to second mass 104, second mass 104 may include hardware components of the transducer 100. For example, second mass 104 may include a magnet assembly 120 and a basket 122. In some aspects, magnet assembly 120 may include one or more magnets (e.g., permanent magnets) and a yoke that form a gap within which voice coil 114 is positioned. The magnets and yoke in combination form a magnetic circuit or magnetic return path for a magnetic field used tp1o drive a movement of voice coil 114 (and in turn sound radiating surface 110) along the axis of vibration 118. The magnet assembly 120 may be coupled basket 122 and a suspension member 126 may attach the basket 122 to third mass 106. The suspension member 126 may be a flexible or otherwise compliant member that allows second mass 104 (e.g., magnet assembly 120 and basket 122) to move relative to third mass 106. In addition, the suspension member 116 of first mass 102 may be attached to another portion of basket 122 such that first mass 102 moves relative to both second mass 104 and third mass 106. In some aspects, the suspension member 116 of the first mass 102 is out of plane and axially aligned with the suspension member 126 of the second mass 104 as shown. In this configuration, a radiating surface area of second mass 104 may be understood as being effectively zero and therefore does not significantly impact the force cancelling performance of the system as will later be described in more detail.

Referring now in more detail to third mass 106, as previously discussed, third mass 106 may be the enclosure, housing, case or module of the device that the first mass 102 and second mass 104 are coupled to and/or within which the transducer assembly 100 is integrated. In this aspect, where the third mass 106 is the enclosure, it may have a side enclosure wall 106A and a bottom enclosure wall 106B that together define an enclosure volume (Vbox). The enclosure volume (Vbox) may be a volume of air that is separated from the surrounding ambient environment by the enclosure walls 106A, 106B. In addition, the enclosure volume (Vbox) may be separated from the back or interior volume (Vb) by the second mass 104. The enclosure volume (Vbox) may have a pressure (P) which may be a parameter than can impact a movement of the second mass 104 within the enclosure volume (Vbox). Said another way, the enclosure volume (Vbox) may be considered an air spring in that it may have a compliance or stiffness that can impact a movement of the second mass 104. In some aspects, an air vent or leak port or opening 132 may be formed between enclosure volume (Vbox) and interior volume (Vb), or an air vent or leak port or opening 134 may be formed between the enclosure volume (Vbox) and the ambient environment. The vents or leak ports 132, 134 may decrease a pressure within the interior volume (Vb) or enclosure volume (Vbox), which in turn may make the volume more compliant (or less stiff) as desired.

In some aspects, the third mass 106 may be understood as the part of the transducer assembly 100 subject to undesirable movements, vibrations, hopping, etc. due to force imbalances within the system and which can be made stationary by the force cancellation achieved herein. Representatively, in some aspects, one or more of the components of the system may be balanced or tuned to reduce a vibration of third mass 106 caused by, for example, a movement of the first mass 102 and second mass 104 relative to third mass 106. For example, in one aspect, a stiffness of the suspension member 126 coupling the second mass 104 to the third mass 106 may be considered balanced or tuned relative to the stiffness of the enclosure volume to reduce the vibration of the third mass 106.

Representatively, as previously discussed, for a sealed box configuration (e.g., no ports, passive radiators, etc), forces on the case at a number of frequencies can be cancelled where the k2 and the damping in the spring (e.g., the suspension member) are tuned or otherwise balanced. One representative equation for perfect force cancelling and tuning K2 may be as follows:

$$k_2 = k_{box}\frac{S_1^2 m_2 - S_2^2 m_1 - S_1 S_2 m_1 + S_1 S_2 m_2}{m_1}$$

where $$k_{box} \equiv \frac{\rho_o c^2}{V_{box}}$$

Representatively, in the context of assembly 100 of FIG. 1, first mass 102 (m1), may be understood as having a diameter defining a first radiating area (s1). In addition, the suspension member 116 of first mass 102 (m1) acts like a spring and may have a constant k1 (e.g., stiffness) between the first mass 102 (m1) and the second mass 104 (m2). Second mass 104 (m2), may in some aspects, further have a diameter defining a second radiating area (s2). In the configuration illustrated in FIG. 1, however, the second radiating area (s2) may be considered zero and therefore second mass 104 in this configuration may be considered as having effectively no surface radiating area (s2). Therefore, in this aspect, only the first mass 102 (m1) defines a radiating area (s1) of the assembly 100. The suspension member 126 of second mass 104 (m2) may further act like a spring and have a constant k2 (e.g., stiffness) between the second mass 104 (m2) and the third mass 106 (m3). The constant k2 can be selected (e.g., tuned or balanced) based on the previously discussed equation. For example, the stiffness of the suspension member (k2) relative to the enclosure volume stiffness (kbox) can be tuned so that all the forces that are acting on the mass (m3) are effectively cancelled. Said another way, if the stiffness is selected so that the forces acting on first mass 102 (m1) and second mass 104 (m2) are equal and opposite, than the case displacement will be equal to zero. In addition, it should be recognized that since in this configuration, the second radiating area (s2) of second mass 104 is zero, the top radiating area may be smaller without impacting performance.

Figure 2A:
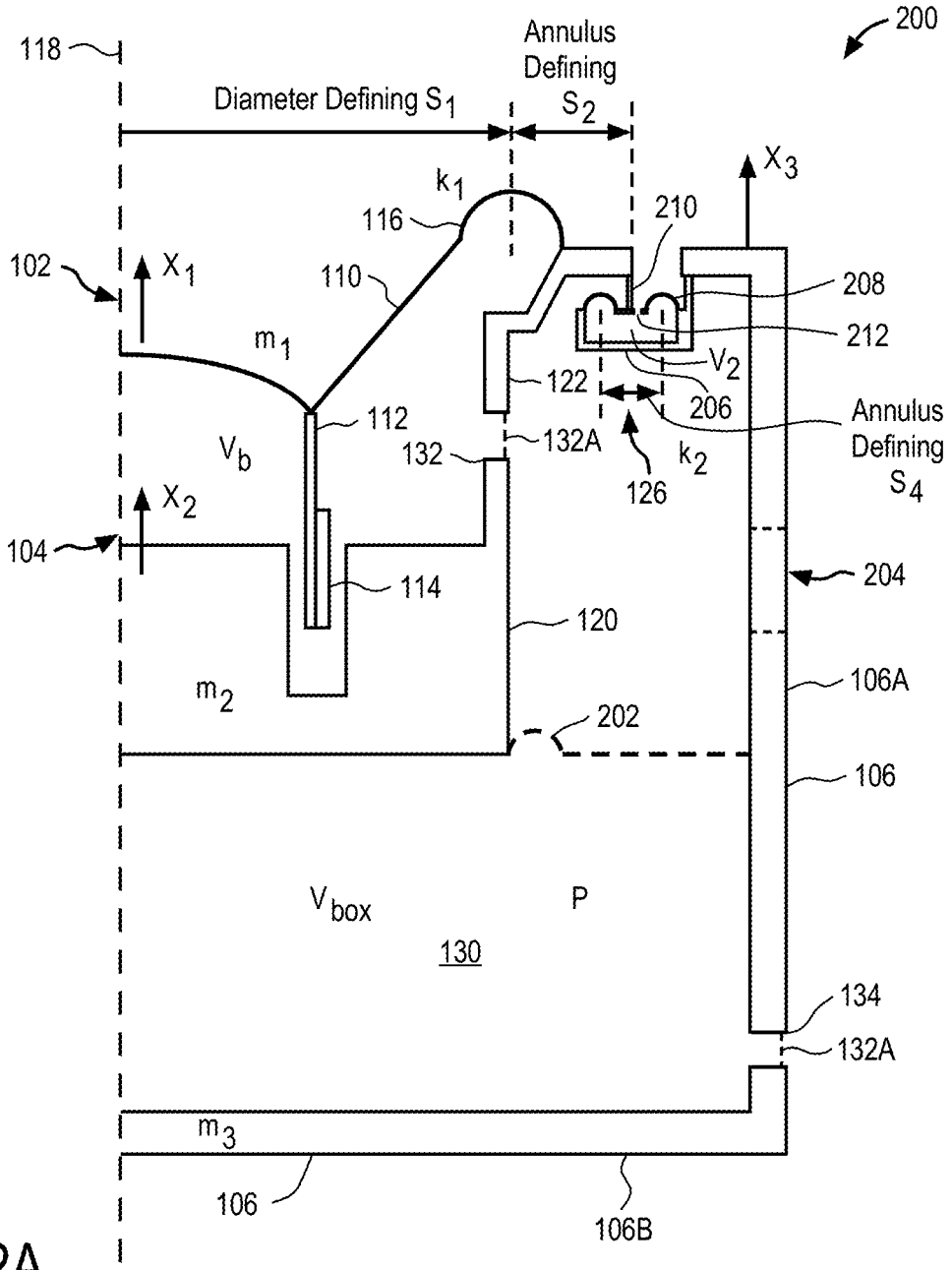
FIG. 2A illustrates a cross-sectional side view of one aspect of a transducer assembly.
Figure 2B:
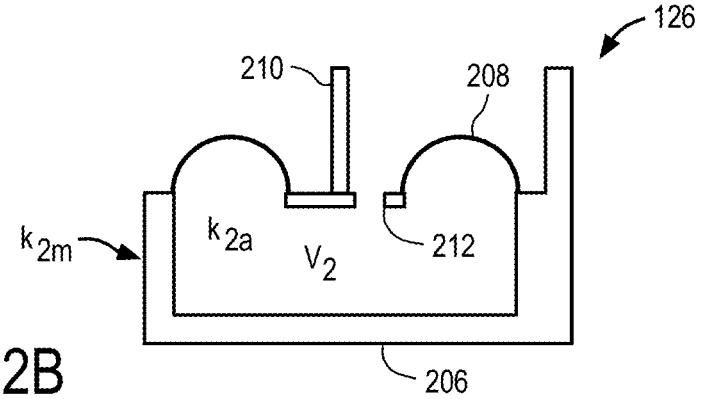
FIG. 2B illustrates a magnified cross-sectional side view of one aspect of the transducer assembly of FIG. 2A.

Referring now to FIG. 2A and FIG. 2B, FIG. 2A and FIG. 2B illustrate a transducer assembly 200 similar in some aspects to the assembly 100 of FIG. 1. Transducer assembly 200, however, includes an air spring that can help minimize an impact of temperature or pressure changes on the balanced or tuned assembly. Representatively, when the transducer assembly is tuned as previously discussed at one elevation, but then changes elevation, the air stiffness of the enclosure volume (Vbox) changes proportionally to the resulting atmospheric pressure change, while the stiffness (k2) of the mechanical spring component (e.g., suspension member 126) remains the same. This may, in turn, result in an assembly imbalance. In addition, different temperatures can impact the stiffness (k2) of the mechanical spring component (e.g., the spring may be stiffer at lower temperatures and less stiff at higher temperatures). Transducer assembly 200 solves this issue by incorporating an air spring having an air volume with a stiffness that can change similar to the enclosure volume (Vbox), and proportionally with the air/temperatures changes.

Representatively, similar to transducer assembly 100, transducer assembly 200 may include first mass 102, second mass 104 and third mass 106. As illustrated by FIG. 2A, in the absence of force cancelling as disclosed herein, the displacement (x1) of first mass 102 and the displacement (x2) of second mass 104 may cause a displacement (x3) of the third mass 106. The displacement (x3) can, however, be reduced to zero when forces on first mass 102 and second mass 104 are equal and opposite. Referring now in more detail to assembly 200, mass 102 may include sound radiating surface 110, bobbin 112 and voice coil 114 coupled to second mass 104 by suspension member 116. First mass 102 may have a diameter defining a radiating surface area (s1) and suspension member 116 may have a stiffness (k1), as previously discussed. Second mass 104 may include magnet assembly 120 and basket 122 that are coupled to third mass 106 by suspension member 126. In some aspects, an optional suspension member 202 may further be used to couple second mass 104 to third mass 106. The optional suspension member 202 may, for example, be out of plane to the suspension member 126. For example, suspension member 126 may be near a top of second mass 104 and optional suspension member 202 may be near a bottom of second mass 104 to provide added stability. Third mass 106 may be an enclosure, case or housing having a side enclosure wall 106A and a bottom enclosure wall 106B that together define the enclosure volume (Vbox). In some cases, the enclosure volume (Vbox) may be vented to the back volume (Vb) of first mass 102 by a port or vent 132 or the ambient environment by a port or vent 134 in an enclosure wall (e.g. side enclosure wall 106A). The ports or vents 132, 134 may help to open the back volume (Vb) or enclosure volume (Vbox) and decreases back pressure, which in turn makes the space more compliant (e.g., less stiff). In addition, in some aspects, an optional passive radiator 204 may be formed in one of the walls of enclosure 106.

Referring now in more detail to suspension member 126 in transducer assembly 200, suspension member 126 includes both a mechanical component and an air spring component that allow a stiffness of suspension member 126 to change similar to the enclosure volume (Vbox), and proportionally with the air/temperatures changes. Representatively, suspension member 126 includes a spring enclosure 206 fixedly mounted to third mass 106 and a surround 208 which together enclose and define an air spring volume (v2). The air spring volume (v2) may define a separate air volume from the enclosure volume (Vbox). The air spring volume (v2) may have a stiffness than can change similar to the enclosure volume (Vbox) as previously discussed. A piston 210 is fixedly coupled at one end to the second mass 104 and another end to the surround 208. This, in turn, movably couples the second mass 104 to the third mass 106. In particular, the compliance of the air spring volume (v2) allows the second mass 104 to move relative to the third mass 106. In addition, changes in the compliance or stiffness of the air spring volume (v2) are proportional to the changes in the atmosphere or temperature, and therefore the suspension member 126 remains tuned even at different elevations and/or temperatures.

Representatively, in referring to the previously discussed force cancelling equation and as illustrated in FIG. 2A, first mass 102 may have a diameter defining a first radiating surface area (s1) and second mass 104 may have an annulus defining a second radiating surface area (s2). In addition, suspension member 126 may have a stiffness (k2), an annulus defining a radiating surface area (s4) and an air spring volume (v2). The stiffness (k2) is made up of an air spring (k2a) and a mechanical spring (k2m) instead of just a mechanical spring (k2=k2m+k2a). In some aspects, the mechanical component (k2m) is made small relative to the air spring component (k2a). Representatively, the mechanical component (k2m) may be just stiff enough to keep the transducer secure during operation and drop tests, as the lower the ratio of k2m/k2a, the less susceptible the force canceling performance is to elevation and temperature changes. For example, the ratio of k2m/k2a may be less than about 1 in order to gain significant robustness benefits against elevation changes, with a ratio of 0.2 being even more robust. In some aspects, the mechanical component may be made up of the piston 210, surround 208 and spring enclosure 206. The air spring component may be made up of the air spring volume (v2) and have stiffness k2a. Since the air spring volume (v2) has a stiffness (e.g., first stiffness) that changes with altitude and temperature the same way the enclosure volume (Vbox) stiffness (e.g., a second stiffness) changes, the force canceling performance will be more robust to changes in the environment. In addition, it is possible to better match the damping terms in the equation for perfect force canceling.

In some aspects, damping can be controlled by matched acoustic resistances (controlled resistive leaks) between the spring volume (v2) and external or ambient air, and between the enclosure volume (Vbox) and the external or ambient air. For example, a vent or port 212 may be formed through piston 210 such that the spring volume (v2) is vented to the external air. In addition, as previously discussed, a vent or port 134 may be formed through a wall of enclosure 106 (e.g., one of walls 106A or 106B) to vent the enclosure volume (Vbox) to the ambient environment. The vents or ports 212, 132, 134 may also include an acoustic mesh or screen 132A to control the acoustic resistance. In still further aspects, although not shown, a vent or port may be provided between the spring volume (v2) and the enclosure volume (Vbox) (e.g., through the spring enclosure 206), as well as the enclosure volume (Vbox) and the outside ambient environment, instead of between the spring volume (V2) and the ambient environment. In the disclosed configuration, force cancelling can be achieved based on the following:

Requirement:

$$k_2 = k_{box}\frac{S_1^2 m_2 - S_2^2 m_1 - S_1 S_2 m_1 + S_1 S_2 m_2}{m_1}$$

where:

$$k_{box} \equiv \frac{\rho_o c^2}{V_{box}}$$

and $$k_2 \equiv k_{2m} + S_4^2\frac{\rho_o c^2}{V_2}$$

Figure 3:
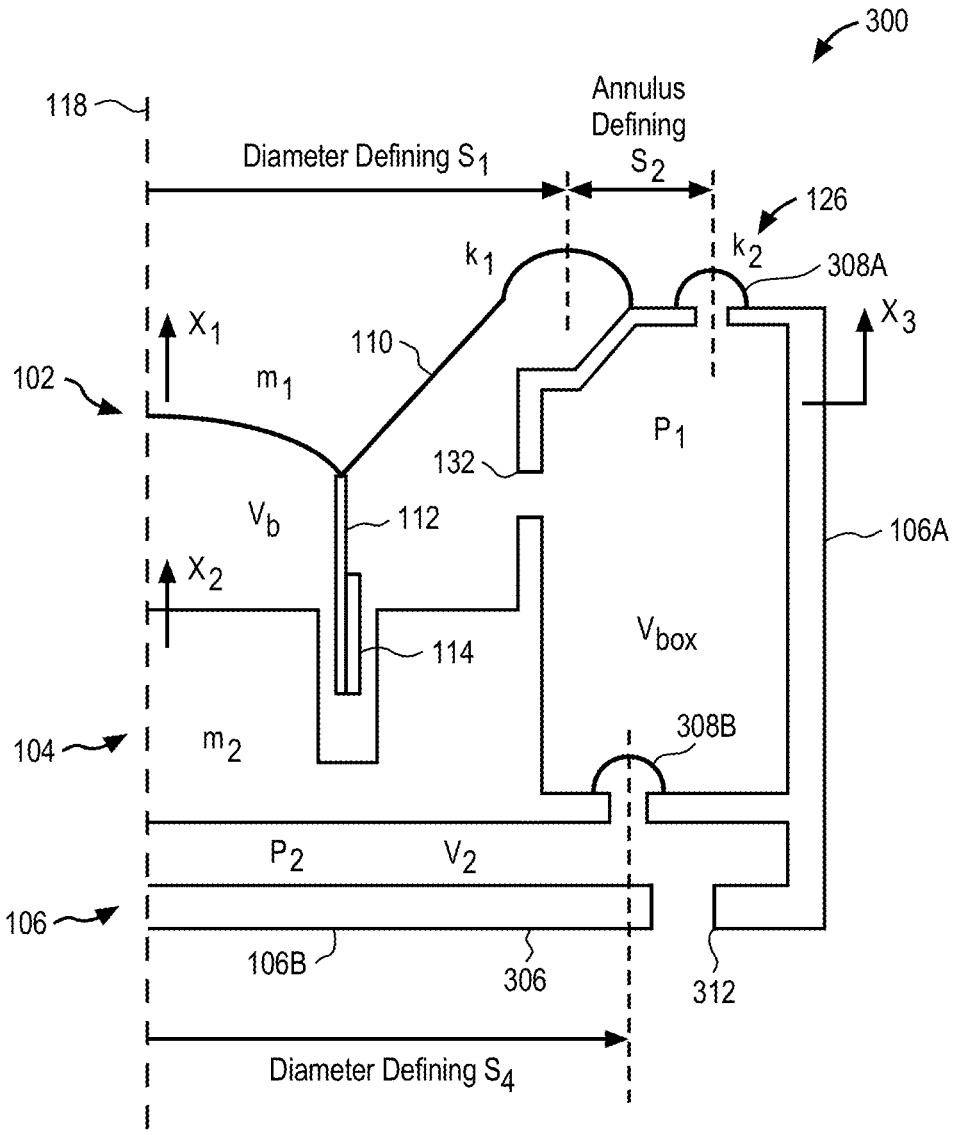
FIG. 3 illustrates a cross-sectional side view of one aspect of a transducer assembly.

FIG. 3 illustrates a cross-sectional side view of a transducer assembly 300. Transducer assembly 300 is similar to transducer assembly 200 of FIG. 2A-B in that it includes a first mass 102, a second mass 104 and a third mass 106. The first mass 102 is coupled to the second mass 104 by suspension member 116 as previously discussed. The second mass 104 is coupled to the third mass 106 by a suspension member 126 having both a mechanical component and an air spring component. Representatively, the suspension member 126 includes a spring enclosure 306 fixedly mounted to third mass 106, a surround 308A and a surround 308B. The surround 308A and surround 308B together couple the second mass 104 to the third mass 106. Surround 308A may be out of plane to surround 308B for added stability. For example, surround 308A may be attached to a top portion of second mass 104 and surround 308B may be attached to a bottom portion of second mass 104. The other side of surrounds 308A, 308B may be attached to the side enclosure wall 106A. The spring enclosure 306 and the surround 308B in combination may enclose and define an air spring volume (v2) that is below the second mass 104. The air spring volume (v2) may define a separate air volume from the enclosure volume (Vbox). The enclosure volume (Vbox) may be along a side of second mass 104 and between surround 308A and surround 308B. The air spring volume (v2) may have a stiffness and pressure (P2) that can change similar to the enclosure volume (Vbox) stiffness and pressure (P1) as previously discussed. In this aspect, the compliance of the air spring volume (v2) allows the second mass 104 to move relative to the third mass 106. In addition, changes in the compliance or stiffness of the air spring volume (v2) are proportional to the changes in the atmosphere or temperature, and therefore the suspension member 126 remains tuned even at different elevations and/or temperatures.

Representatively, similar to the transducer assembly 200 of FIG. 2A-B, first mass 102 may have a diameter defining a first radiating surface area (s1) and second mass 104 may have an annulus defining a second radiating surface area (s2). In addition, suspension member 126 may have a stiffness (k2), an annulus defining a radiating surface area (s4) and an air spring volume (v2). The stiffness (k2) may be made up of an air spring (k2a) and a mechanical spring (k2m) instead of just a mechanical spring (k2=k2m+k2a), as previously discussed. In some aspects, the mechanical component (k2m) is made small relative to the air spring component (k2a). In addition, in this configuration, both surrounds 308A, 308B are included in the mechanical spring component (k2m). In addition, in some aspects, the assembly 300 may further include a leak or port 132 from the back volume (Vb) to the enclosure volume (Vbox) and/or a leak or port 312 from the air spring volume (v2) through the bottom enclosure wall 106B to the ambient environment. The vents or ports 132, 312 may also include an acoustic mesh or screen to control the acoustic resistance as previously discussed. In the disclosed configuration, force cancelling can be achieved based on the following:

Requirement:

$$k_2 = k_{box}\frac{m_1\left(-S_1^2 + 2S_2S_4 - S_2^2 - S_4^2 - 2S_1S_2 + 2S_1S_4\right) + m_2S_1(S_1 + S_2 - S_4)}{m_1}$$

Where $$k_{box} \equiv \frac{\rho_o c^2}{V_{box}}$$

and $$k_2 \equiv k_{2m} + S_4^2\frac{\rho_o c^{2m_1}}{V_2}$$

It should be understood that any of the previously discussed configurations can provide force canceling for, in some aspects, sealed enclosure configurations (e.g., sealed boxes). In the case of systems with passive radiators or ports (e.g., vented boxes), different configurations may be used to achieve force cancelling. Some representative vented box configurations will now be described in reference to FIG. 4, FIG. 5, FIG. 6, FIG. 7 and FIG. 8.

Figure 4:
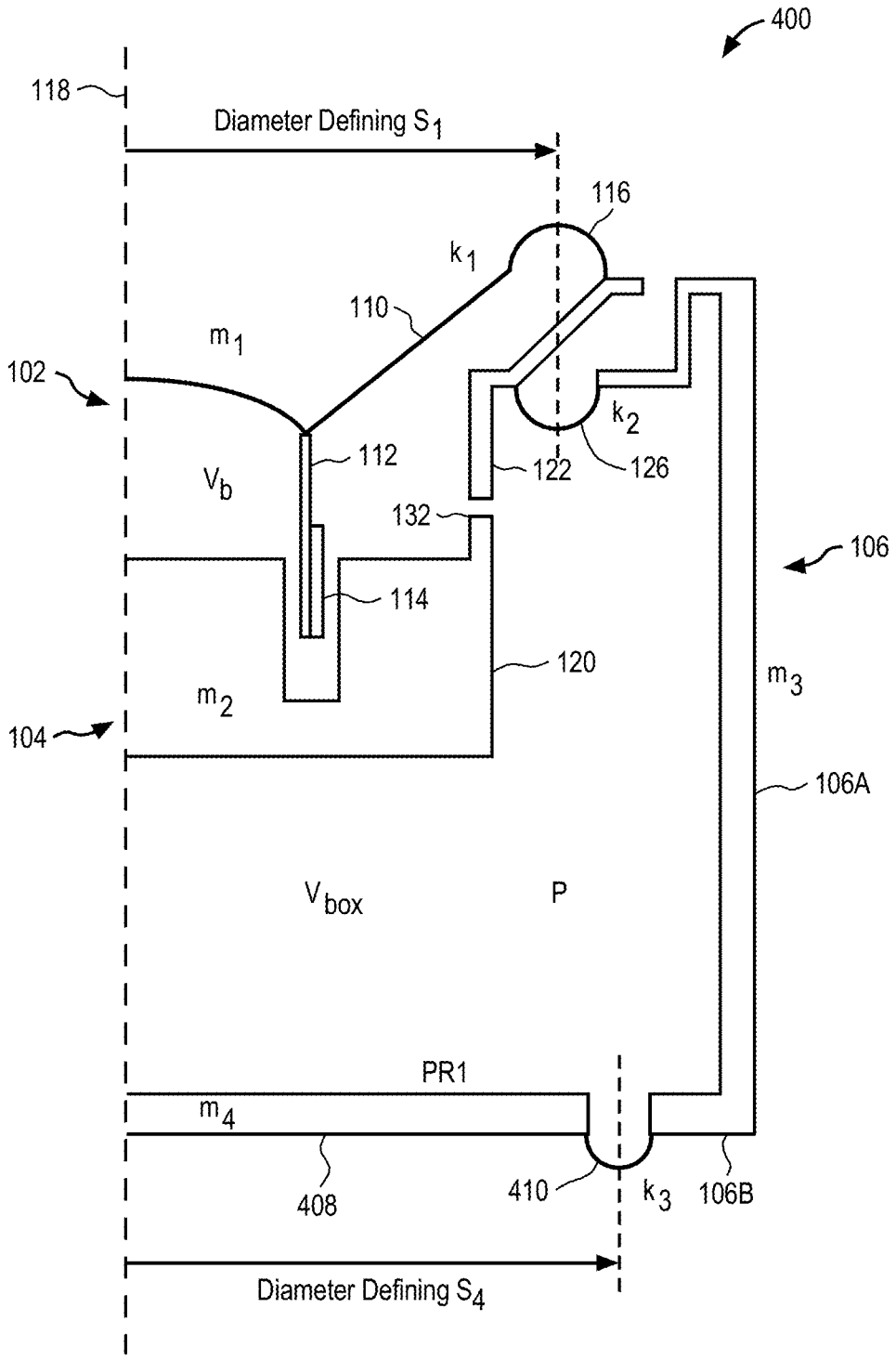
FIG. 4 illustrates a cross-sectional side view of one aspect of a transducer assembly.

FIG. 4 illustrates a cross-sectional side view of a transducer assembly 400 including a passive radiator. Similar to the previously discussed transducer assemblies, transducer assembly 400 includes a first mass 102, a second mass 104 and a third mass 106. Each of the first mass 102, second mass 104 and third mass 106 include the same components as previously discussed in reference to transducer assembly 100 of FIG. 1. Representatively, first mass 102 includes sound radiating surface 110, bobbin 112 and voice coil 114 connected to second mass 104 by suspension member 116. Second mass 104 includes magnet assembly 120 and basket 122 connected to third mass 106 by suspension member 126. Suspension member 116 and suspension member 126 may be out of plane and axially aligned similar to the arrangement previously discussed in reference to FIG. 1. Third mass 106 may be, for example, an enclosure, housing or case having a side enclosure wall 106A and bottom enclosure wall 106B that define an enclosure volume (Vbox). Each of the first mass 102, second mass 104 and third mass 106 can move relative to one another. It is desired that third mass 106, however, remain stationary therefore the assembly may be tuned as previously discussed to cancel forces causing any undesired movement of third mass 106.

Transducer assembly 400 further includes a fourth mass 408 (m4) coupled to the bottom enclosure wall 106B. Fourth mass 408 may be, in some aspects, a passive radiator (PR) that is movably coupled to bottom enclosure wall 106B by suspension member 410. Fourth mass 408 may have a diameter defining a radiating surface area (s4) that is in mutual opposition to the radiating surface area (s1) of first mass 102 (previously discussed in reference to FIG. 1). In some aspects, the radiating surface area (s1) of first mass 102 is different than the radiating surface area (s4) of fourth mass 408. Due to the arrangement, a radiating surface area of second mass 104 may be effectively zero. Suspension member 126 may be a spring with constant k2 as previously discussed, and suspension member 410 may be a spring with constant k3. The k2, k3 of the suspension members 126, 410 may be tuned so that vibration-reaction forces of the first mass 102, second mass 104 and/or fourth mass 408 on the third mass 106 (e.g., the enclosure) are effectively cancelled.

Figure 5:
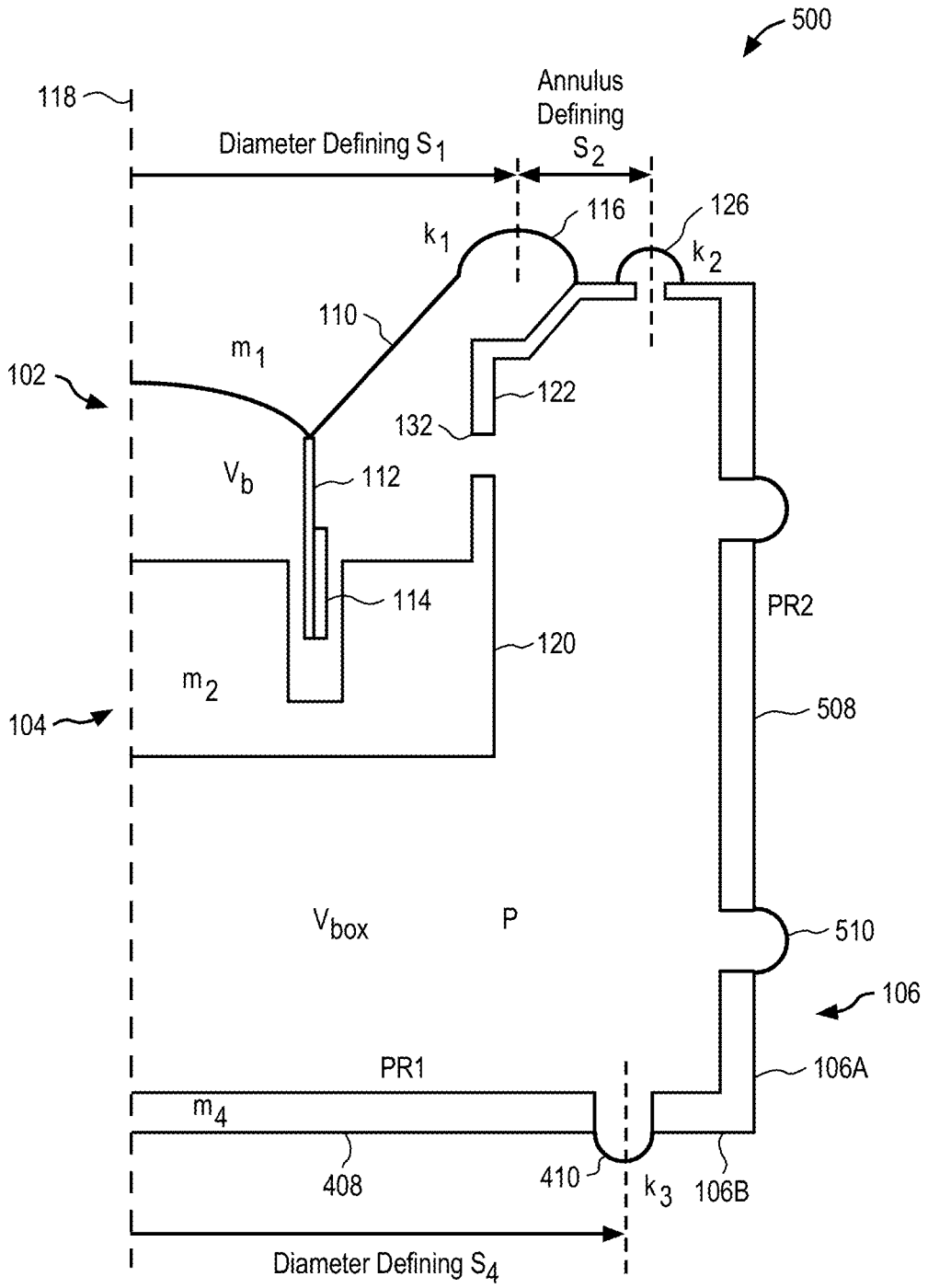
FIG. 5 illustrates a cross-sectional side view of one aspect of a transducer assembly.

FIG. 5 illustrates a cross-sectional side view of a transducer assembly 500 including a passive radiator. Similar to the previously discussed transducer assemblies, transducer assembly 500 includes a first mass 102, a second mass 104 and a third mass 106. Each of the first mass 102, second mass 104 and third mass 106 include the same components as previously discussed in reference to transducer assembly 100 of FIG. 1. Representatively, first mass 102 includes sound radiating surface 110, bobbin 112 and voice coil 114 connected to second mass 104 by suspension member 116. Second mass 104 includes magnet assembly 120 and basket 122 connected to third mass 106 by suspension member 126. In this configuration, however, suspension member 116 and suspension member 126 may be in plane relative to one another similar to the arrangement previously discussed in reference to FIG. 2A-B. Third mass 106 may be, for example, an enclosure, housing or case having a side enclosure wall 106A and bottom enclosure wall 106B that define an enclosure volume (Vbox). Each of the first mass 102, second mass 104 and third mass 106 can move relative to one another.

Similar to transducer assembly 300, transducer assembly 400 further includes a fourth mass 408 coupled to the bottom enclosure wall 106B. Fourth mass 408 may be, in some aspects, a passive radiator (PR1) that is movably coupled to bottom enclosure wall 106B by suspension member 410. Fourth mass 408 may have a diameter defining a radiating surface area (s4) that is in mutual opposition to the radiating surface area (s1) of first mass 102 (previously discussed in reference to FIG. 1) and the radiating surface area (s2) of second mass 104 (previously discussed in reference to FIG. 2A). In some aspects, the radiating surface area (s1) of first mass 102 and radiating surface area (s2) of second mass together may be the same or different than the radiating surface area (s4) of fourth mass 408. Suspension member 126 may be a spring with constant k2 as previously discussed, and suspension member 410 may be a spring with constant k3. The k2, k3 of the suspension members 126, 410 may be tuned so that vibration-reaction forces of the first mass 102, second mass 104 and/or fourth mass 408 on the third mass 106 (e.g., the enclosure) are effectively cancelled.

In some aspects, assembly 500 may further include a fifth mass 508 movably coupled to a side enclosure wall 106A by suspension member 510. Fifth mass 508, in some aspects, may be a passive radiator (PR2) used to provide lateral force cancelling for added stability. It should further be understood that, although not explicitly shown, a side wall passive radiator 508 similar to that shown in assembly 500 may be included in any of the previously discussed transducer assembly configurations to provide lateral force cancelling.

Figure 6:
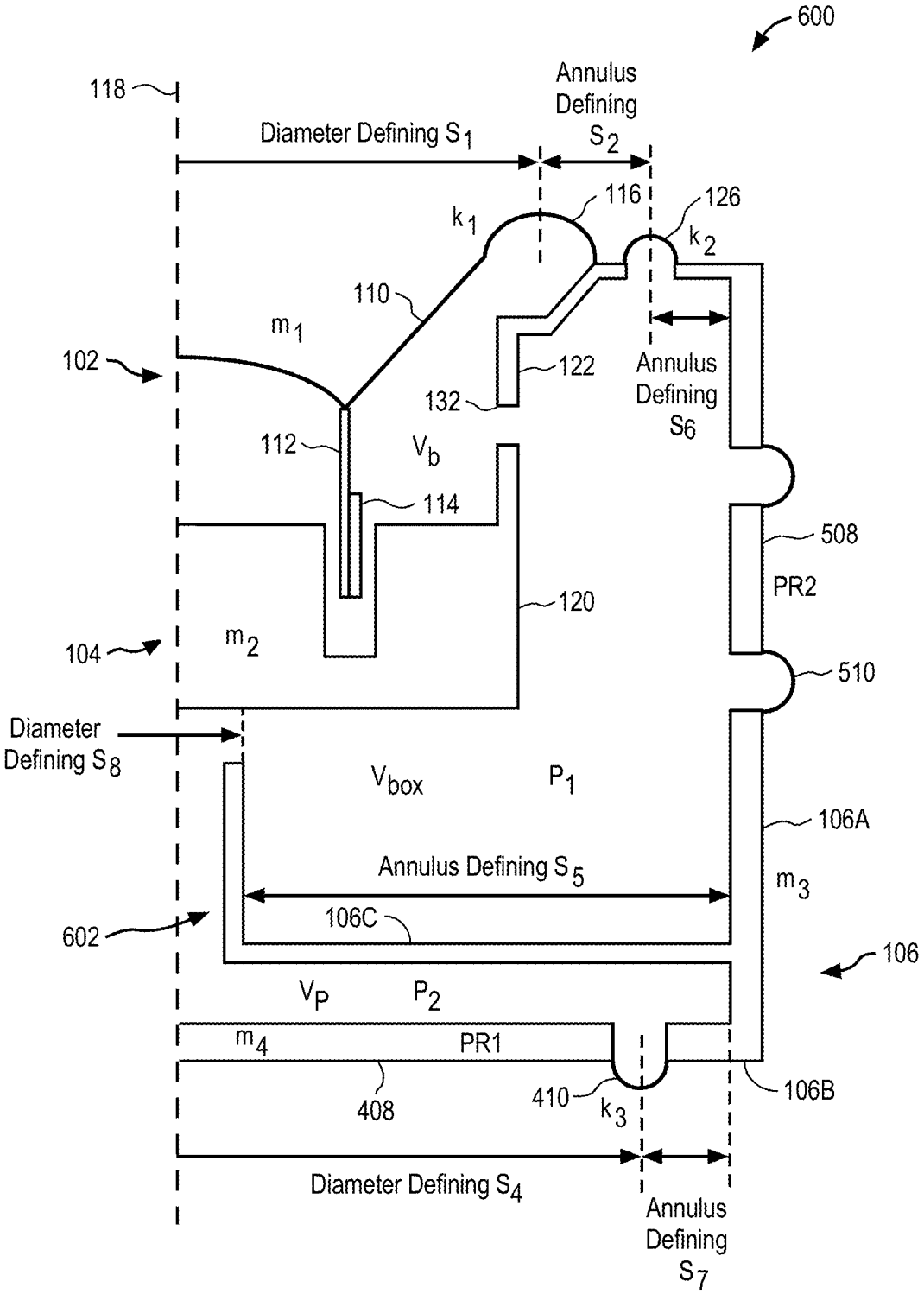
FIG. 6 illustrates a cross-sectional side view of one aspect of a transducer assembly.

FIG. 6 illustrates a cross-sectional side view of a transducer assembly 600 including a passive radiator. Similar to the previously discussed transducer assemblies, transducer assembly 600 includes a first mass 102, a second mass 104, a third mass 106, a fourth mass 408 and optional fifth mass 508. Each of the first mass 102, second mass 104, third mass 106, fourth mass 408 and optional fifth mass 508 include the same components as previously discussed in reference to transducer assembly 500 of FIG. 5. Representatively, first mass 102 includes sound radiating surface 110, bobbin 112 and voice coil 114 connected to second mass 104 by suspension member 116. Second mass 104 includes magnet assembly 120 and basket 122 connected to third mass 106 by suspension member 126. Third mass 106 may be, for example, an enclosure, housing or case having a side enclosure wall 106A and bottom enclosure wall 106B that define an enclosure volume (Vbox). Fourth mass 408 may be a passive radiator (PR1) movably coupled to the bottom enclosure wall 106B by a suspension member 410. Fifth mass 508 may be a passive radiator (PR2) movably coupled to the side enclosure wall 106A by a suspension member 510. Each of the first mass 102, second mass 104, third mass 106, fourth mass 408 and optional fifth mass 508 can move relative to one another to provide axial/vertical force cancelling and/or lateral/horizontal force cancelling.

Transducer assembly 600 further includes an interior enclosure wall 106C that defines a port 602 in front of fourth mass 408. Representatively, port 602 may be an opening, channel or tube that is formed by the interior enclosure wall 106C and connects a passive radiator volume (Vp) having a pressure (P2) with the enclosure volume (Vbox) having a pressure (P1).

Similar to the previously discussed configurations, each of the moving components may define a radiating surface area and/or stiffness that can be balanced or tuned to cancel forces on the enclosure or third mass 106. Representatively, first mass 102 defines a radiating surface area (s1), second mass 104 defines a radiating surface area (s2), fourth mass 408 defines a radiating surface area (s4), the interior enclosure wall 106C defines a fifth radiating surface area (s5), the portion of the third mass 106 between suspension 126 and the side enclosure wall 106A may define a radiating surface area (s6), the annulus between the suspension member 410 and bottom enclosure wall 106B may define a radiating surface area (s7) and the port 602 may have a radiating surface area (s8). The force on the third mass 106 (e.g., the case) may be considered balanced when the following conditions are met and the forces from k2 and k3 are equal and opposite, or considered approximately balanced when the following conditions are met and the forces from k2 and k3 are negligible:

$$(P_1-P_2)S_5+P_2S_7=P_1S_6$$

Figure 7:
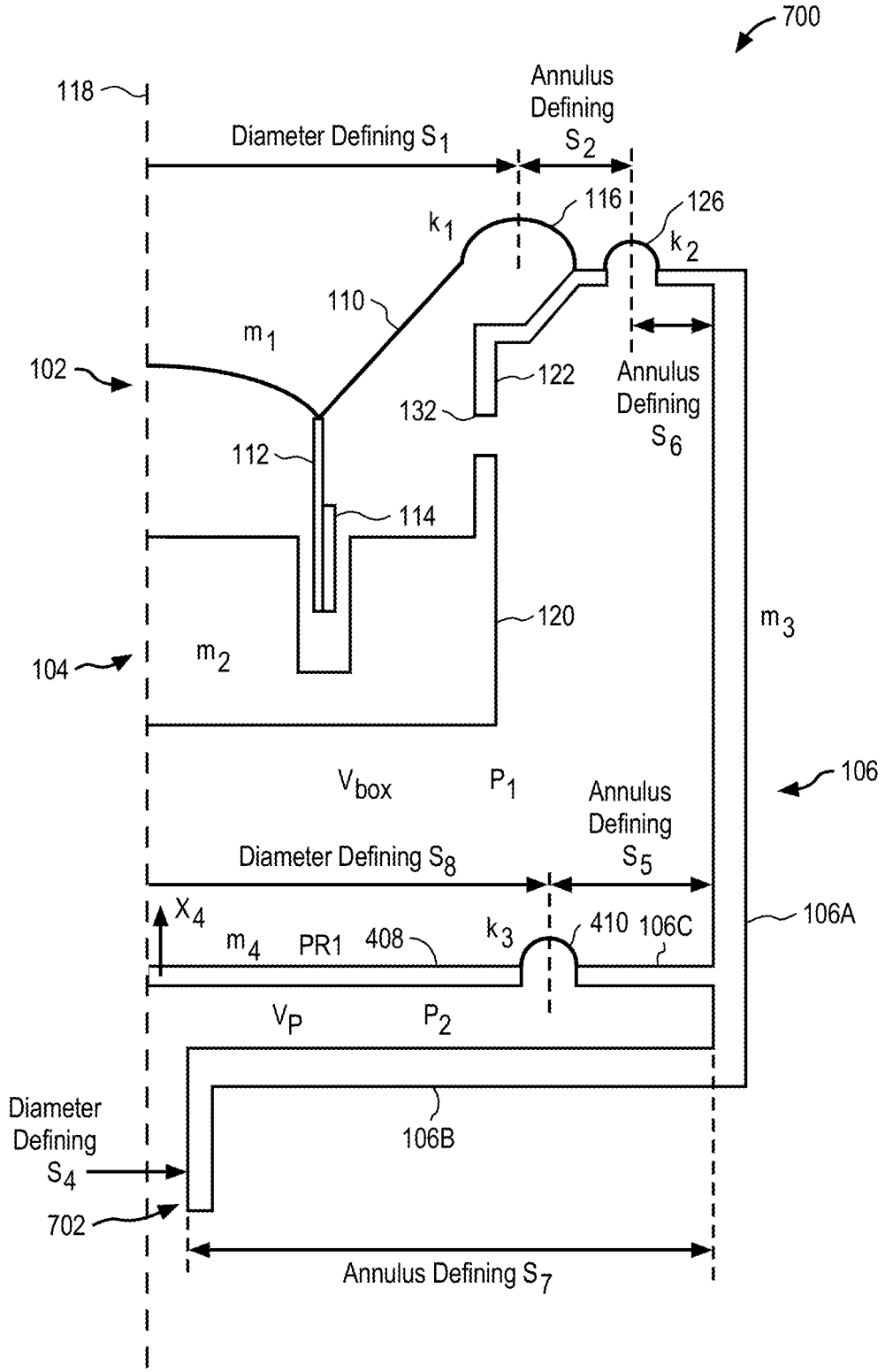
FIG. 7 illustrates a cross-sectional side view of one aspect of a transducer assembly.

FIG. 7 illustrates a cross-sectional side view of a transducer assembly 700 including a passive radiator. Similar to the previously discussed transducer assemblies, transducer assembly 700 includes a first mass 102, a second mass 104, a third mass 106, a fourth mass 408 and may further include an optional fifth mass (e.g, a side passive radiator). Each of the first mass 102, second mass 104, third mass 106, and fourth mass 408 may include the same components as previously discussed in reference to transducer assembly 600 of FIG. 6. Representatively, first mass 102 includes sound radiating surface 110, bobbin 112 and voice coil 114 connected to second mass 104 by suspension member 116. Second mass 104 includes magnet assembly 120 and basket 122 connected to third mass 106 by suspension member 126. Third mass 106 may be, for example, an enclosure, housing or case having a side enclosure wall 106A and bottom enclosure wall 106B that define an enclosure volume (Vbox).

In this aspect, however, fourth mass 408 may be a passive radiator (PR1) movably coupled to the interior enclosure wall 106C, instead of the bottom enclosure wall 106B, by a suspension member 410. Each of the first mass 102, second mass 104, third mass 106, and fourth mass 408 can move relative to one another to provide axial/vertical force cancelling.

Transducer assembly 600 further includes a port 702 that is behind or below the fourth mass 408. Representatively, port 702 may be an opening, channel or tube that is formed by the bottom enclosure wall 106B and connects a passive radiator volume (Vp) having a pressure (P2) with an ambient environment outside of the enclosure.

Similar to the previously discussed configurations, each of the moving components may define a radiating surface area and/or stiffness that can be balanced or tuned to cancel forces on the enclosure or third mass 106. Representatively, first mass 102 defines a radiating surface area (s1), second mass 104 defines a radiating surface area (s2), fourth mass 408 defines a radiating surface area (s8), the interior enclosure wall 106C defines a radiating surface area (s5), the portion of the third mass 106 between suspension 126 and the side enclosure wall 106A may define a radiating surface area (s6), the annulus between the port 702 and side enclosure wall 106A may define a radiating surface area (s7) and the port 702 may have a radiating surface area (s4). The force on the third mass 106 (e.g., the case) may be considered balanced when the following conditions are met and the forces from k2 and k3 are equal and opposite, or considered approximately balanced when the following conditions are met and the forces from k2 and k3 are negligible:

$$(P_1-P_2)S_6+P_2S_7=P_1S_6$$

Figure 8:
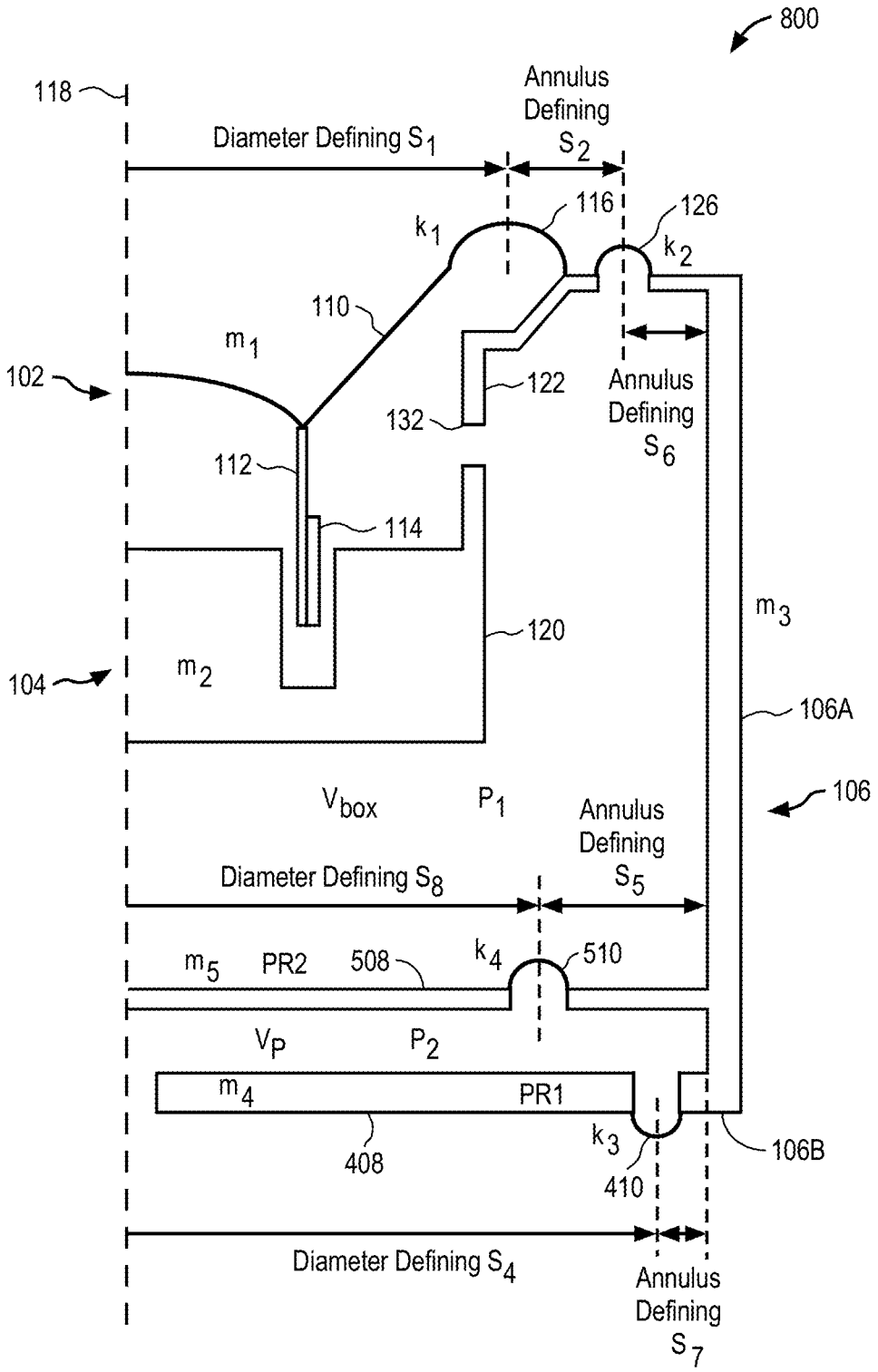
FIG. 8 illustrates a cross-sectional side view of one aspect of a transducer assembly.

FIG. 8 illustrates a cross-sectional side view of a transducer assembly 800 including a passive radiator. Similar to the previously discussed transducer assemblies, transducer assembly 800 includes a first mass 102, a second mass 104, a third mass 106, a fourth mass 408 and a fifth mass 508. Each of the first mass 102, second mass 104, third mass 106, fourth mass 408 and fifth mass 508 may include the same components as previously discussed in reference to transducer assembly 600 of FIG. 6. Representatively, first mass 102 includes sound radiating surface 110, bobbin 112 and voice coil 114 connected to second mass 104 by suspension member 116. Second mass 104 includes magnet assembly 120 and basket 122 connected to third mass 106 by suspension member 126. Third mass 106 may be, for example, an enclosure, housing or case having a side enclosure wall 106A and bottom enclosure wall 106B that define an enclosure volume (Vbox). Fourth mass 408 may be a passive radiator (PR1) movably coupled to the bottom enclosure wall 106B by a suspension member 410. Fifth mass 508 may be a passive radiator (PR2) movably coupled to the interior enclosure wall 106C, instead of the bottom enclosure wall 106B, by a suspension member 510 having a stiffness (k4). A passive radiator volume (Vp) having a pressure (p2) may be defined between the passive radiator (PR1) and the passive radiator (PR2) as shown. The passive radiator volume (Vp) may be separated from the enclosure volume (Vbox) by the interior enclosure wall 106C and passive radiator (PR2) coupled to wall 106C. Each of the first mass 102, second mass 104, third mass 106, fourth mass 408 and fifth mass 508 can move relative to one another to provide axial/vertical force cancelling.

Similar to the previously discussed configurations, each of the moving components may define a radiating surface area and/or stiffness that can be balanced or tuned to cancel forces on the enclosure or third mass 106. Representatively, first mass 102 defines a radiating surface area (s1), second mass 104 defines a radiating surface area (s2), fourth mass 408 defines a radiating surface area (s4), the interior enclosure wall 106C defines a radiating surface area (s5), the portion of the third mass 106 between suspension 126 and the side enclosure wall 106A may define a radiating surface area (s6), the annulus between the suspension 410 and side enclosure wall 106A may define a radiating surface area (s7) and the fifth mass 508 including passive radiator (PR2) may define a radiating surface (s8). The force on the third mass 106 (e.g., the case) may be considered balanced when the following conditions are met and the forces from k2, k3 and k4 cancel, or considered approximately balanced when the following conditions are met and the forces from k2, k3, and k4 are negligible:

$$(P_1-P_2)S_5+P_2S_7=P_1S_6$$

Figure 9:
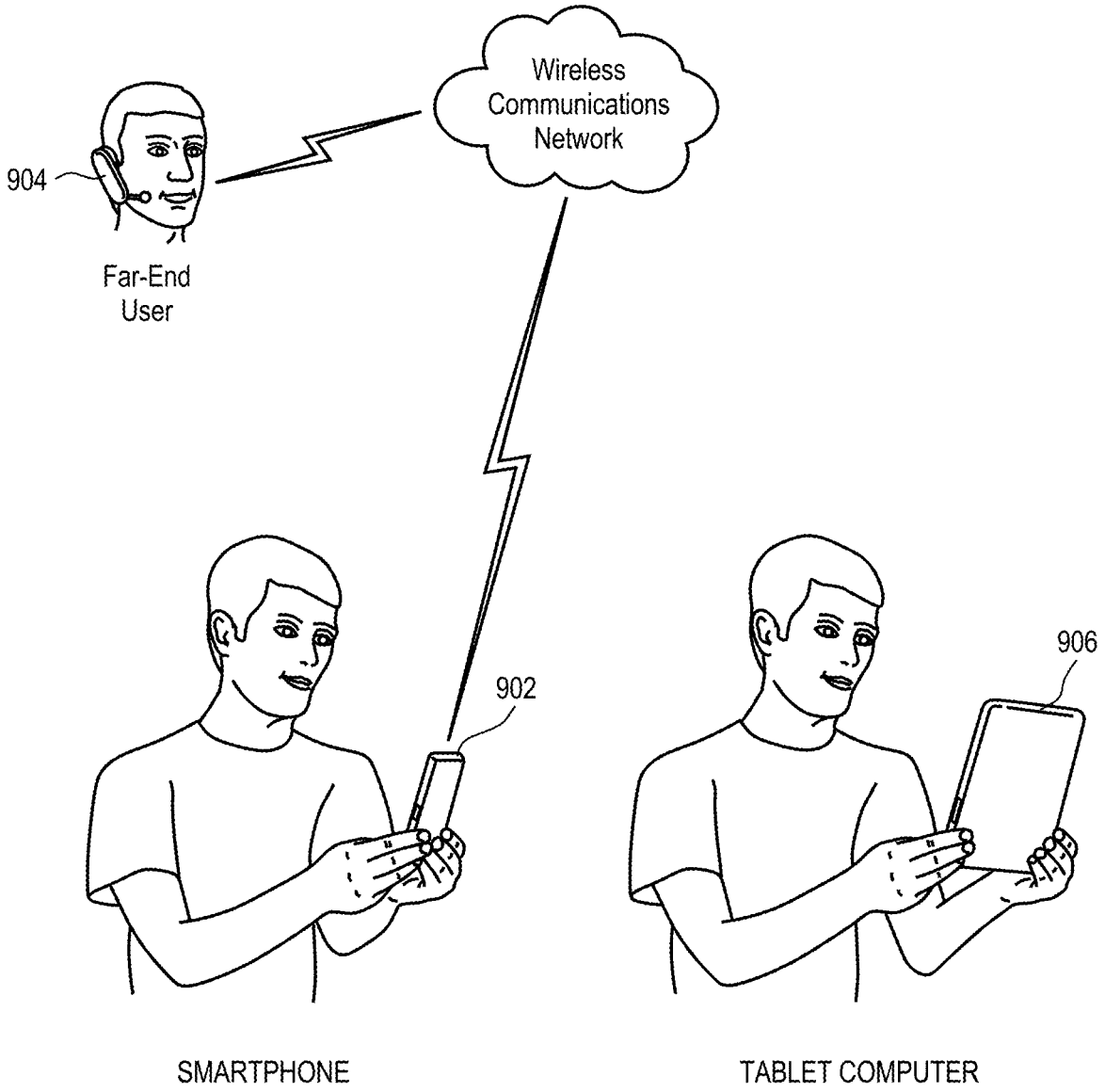
FIG. 9 illustrates a simplified schematic view of an electronic device in which a transducer assembly may be implemented.

FIG. 9 illustrates a simplified schematic perspective view of an exemplary electronic device in which a transducer assembly as described herein, may be implemented. As illustrated in FIG. 9, the transducer assembly may be integrated within a consumer electronic device 902 such as a smart phone with which a user can conduct a call with a far-end user of a communications device 904 over a wireless communications network; in another example, the transducer assembly may be integrated within the housing of a tablet computer 906. These are just two examples of where the transducer assembly described herein may be used; it is contemplated, however, that the transducer assembly may be used with any type of electronic device, for example, a home audio system, any consumer electronics device with audio capability, or an audio system in a vehicle (e.g., an automobile infotainment system.).

Figure 10:
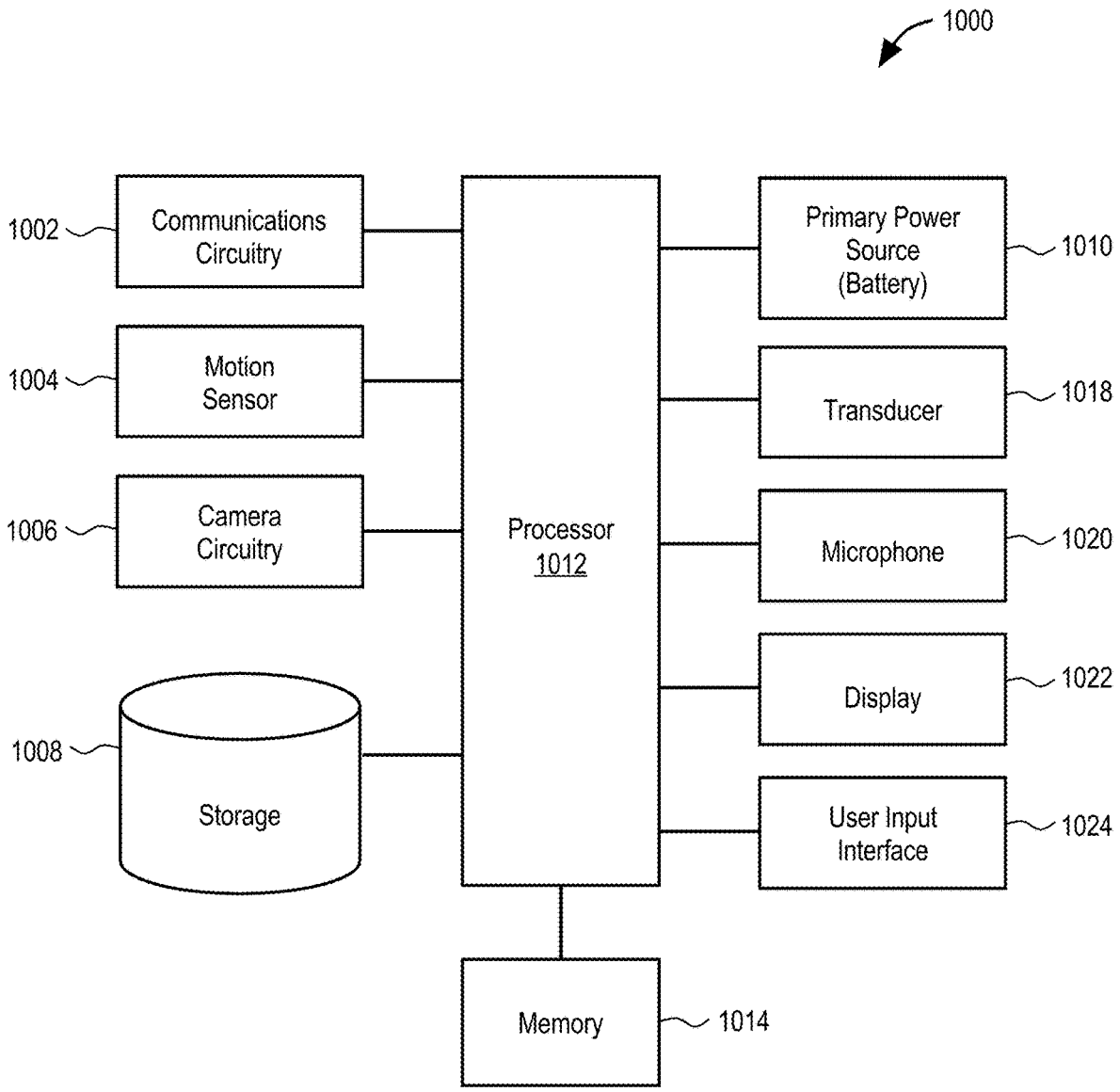
FIG. 10 illustrates a block diagram of some of the constituent components of an electronic device in which a transducer assembly may be implemented.

FIG. 10 illustrates a block diagram of some of the constituent components of an electronic device in which the transducer assembly disclosed herein may be implemented. Device 1000 may be any one of several different types of consumer electronic devices, for example, any of those discussed in reference to FIG. 9.

In this aspect, electronic device 1000 includes a processor 1012 that interacts with camera circuitry 1006, motion sensor 1004, storage 1008, memory 1014, display 1022, and user input interface 1024. Main processor 1012 may also interact with communications circuitry 1002, primary power source 1010, speaker 1018 and microphone 1020. Speaker 1018 may be the transducer assembly described herein, for example, a micro speaker assembly. The various components of the electronic device 1000 may be digitally interconnected and used or managed by a software stack being executed by the processor 1012. Many of the components shown or described here may be implemented as one or more dedicated hardware units and/or a programmed processor (software being executed by a processor, e.g., the processor 1012).

The processor 1012 controls the overall operation of the device 1000 by performing some or all of the operations of one or more applications or operating system programs implemented on the device 1000, by executing instructions for it (software code and data) that may be found in the storage 1008. The processor 1012 may, for example, drive the display 1022 and receive user inputs through the user input interface 1024 (which may be integrated with the display 1022 as part of a single, touch sensitive display panel). In addition, processor 1012 may send an audio signal to speaker 1018 to facilitate operation of speaker 1018.

Storage 1008 provides a relatively large amount of "permanent" data storage, using nonvolatile solid state memory (e.g., flash storage) and/or a kinetic nonvolatile storage device (e.g., rotating magnetic disk drive). Storage 1008 may include both local storage and storage space on a remote server. Storage 1008 may store data as well as software components that control and manage, at a higher level, the different functions of the device 1000.

In addition to storage 1008, there may be memory 1014, also referred to as main memory or program memory, which provides relatively fast access to stored code and data that is being executed by the processor 1012. Memory 1014 may include solid state random access memory (RAM), e.g., static RAM or dynamic RAM. There may be one or more processors, e.g., processor 1012, that run or execute various software programs, modules, or sets of instructions (e.g., applications) that, while stored permanently in the storage 1008, have been transferred to the memory 1014 for execution, to perform the various functions described above.

The device 1000 may include communications circuitry 1002. Communications circuitry 1002 may include components used for wired or wireless communications, such as two-way conversations and data transfers. For example, communications circuitry 1002 may include RF communications circuitry that is coupled to an antenna, so that the user of the device 1000 can place or receive a call through a wireless communications network. The RF communications circuitry may include a RF transceiver and a cellular baseband processor to enable the call through a cellular network. For example, communications circuitry 1002 may include Wi-Fi communications circuitry so that the user of the device 1000 may place or initiate a call using voice over Internet Protocol (VOIP) connection, transfer data through a wireless local area network.

The device may include a speaker 1018. Speaker 1018 may be a transducer assembly such as that described in reference to FIGS. 1-9. Speaker 1018 may be an electric-to-acoustic transducer or sensor that converts an electrical signal input (e.g., an acoustic input) into sound. The circuitry of the speaker may be electrically connected to processor 1012 and power source 1010 to facilitate the speaker operations as previously discussed (e.g, diaphragm displacement, etc).

The device 1000 may further include a motion sensor 1004, also referred to as an inertial sensor, that may be used to detect movement of the device 1000, camera circuitry 1006 that implements the digital camera functionality of the device 1000, and primary power source 1010, such as a built in battery, as a primary power supply.

While certain aspects have been described and shown in the accompanying drawings, it is to be understood that such aspects are merely illustrative of and not restrictive on the broad disclosure, and that the disclosure is not limited to the specific constructions and arrangements shown and described, since various other modifications may occur to those of ordinary skill in the art. The description is thus to be regarded as illustrative instead of limiting. In addition, to aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. A transducer assembly comprising:

an enclosure having a bottom enclosure wall and a side enclosure wall that together define an enclosure volume;

a first mass movably coupled to the enclosure and defining a first radiating area, the first mass comprising a sound radiating surface, a voice coil and a first suspension member coupling the sound radiating surface to the enclosure such that the sound radiating surface is operable to vibrate relative to the enclosure along an axis of vibration;

a second mass movably coupled to the enclosure and defining a second radiating area, the second mass comprising a magnet assembly and a second suspension member coupling the magnet assembly to the enclosure; and a third mass movably coupled to the enclosure and defining a third radiating area, the third mass comprising a passive radiator, at least one of another passive radiator or a port, port and a third suspension member, and wherein the first radiating area and the second radiating area have a combined radiating area that is different than the third radiating area and the combined radiating area is tuned relative to the third radiating area to reduce enclosure vibrations caused by a movement of the first mass and the second mass relative to the enclosure.

2. The transducer assembly of claim 1 wherein the first suspension member is axially aligned with the second suspension member.

3. The transducer assembly of claim 1 wherein an effective radiating area of the second mass is zero.

4. The transducer assembly of claim 1 wherein the second suspension member coupling the magnet assembly to the enclosure comprises a first surround and a second surround that are out of plane relative to one another.

5. The transducer assembly of claim 1 wherein the passive radiator forms part of the bottom enclosure wall.

6. The transducer assembly of claim 1 wherein the third mass forms part of the bottom enclosure wall and separates the enclosure volume from an ambient environment outside of the enclosure.

7. The transducer assembly of claim 1 wherein the enclosure further comprises an interior enclosure wall that separates the enclosure volume from a passive volume between the bottom enclosure wall and the passive radiator of the third mass.

8. The transducer assembly of claim 7 wherein the passive radiator forms part of the bottom enclosure wall, and the interior enclosure wall further comprises the port between the enclosure volume and the passive volume.

9. The transducer assembly of claim 7 wherein the passive radiator forms part of the interior enclosure wall, and the bottom enclosure wall further comprises the port between the passive volume and an ambient environment outside of the enclosure.

10. The transducer assembly of claim 7 wherein the passive radiator is a first passive radiator forming part of the bottom enclosure wall, and the assembly further comprises a fourth mass defining a fourth radiating area, the fourth mass comprising a second passive radiator and a fourth suspension member coupling the second passive radiator to the interior enclosure wall.

11. The transducer assembly of claim 1 wherein the passive radiator is a first passive radiator, and the another passive radiator is a second passive radiator, and the first passive radiator and the second passive radiator are on opposite sides of the enclosure and share a same axis such that the first passive radiator and the second passive radiator provide lateral force cancelling.

12. The transducer assembly of claim 1 wherein the enclosure further comprises an interior enclosure wall that runs parallel to the bottom enclosure wall, and wherein the passive radiator is a first passive radiator coupled to the bottom enclosure wall, the another passive radiator is a second passive radiator, and the second passive radiator and a third passive radiator are coupled to opposite sides of the enclosure.

13. The transducer assembly of claim 1 wherein the enclosure further comprises an interior enclosure wall that defines a passive volume between the passive radiator and the bottom enclosure wall, and wherein the interior enclosure wall comprises an opening from the passive volume to the enclosure volume.

14. The transducer assembly of claim 1 wherein the passive radiator is coupled to an interior enclosure wall that defines a passive volume between the passive radiator and the bottom enclosure wall, and wherein the bottom enclosure wall comprises an opening from the passive volume to an ambient environment surrounding the enclosure.

15. The transducer assembly of claim 14 wherein the opening comprises a channel that is axially aligned with the axis of vibration.

16. The transducer assembly of claim 1 further comprising a vent port formed through the magnet assembly to couple a back volume of the transducer to the enclosure volume, or through the enclosure to couple the enclosure volume to an ambient environment surrounding the enclosure.

17. The transducer assembly of claim 1 wherein a first side passive radiator is coupled to the enclosure by a fourth suspension member with an axis substantially perpendicular to the axis of vibration of the first mass, and a second side passive radiator is coupled to the enclosure by a fifth suspension member with an axis substantially perpendicular to the axis of vibration of the first mass.

18. The transducer assembly of claim 17 wherein the first and second side passive radiators are coupled to opposing sides of the enclosure to provide lateral force canceling.

* * * * *